GUARD POST FOR LOADING DOCKS

BACKGROUND OF THE INVENTION

This invention relates to a guard post and more particularly to a guard post that is used on a loading dock of a warehouse or other building where material is handled primarily through the utilization of fork lifts and other loading equipment.

In the prior art it has been customary to anchor a cylindrical post directly into the foor, which is usually concrete, of a warehouse and then fill the cylindrical post with concrete to stiffen the same. In this type of application the posts are positioned to protect the door opening but if they are hit by a lift truck with any particular force, they will bend or become dislodged from the embeddment in the concrete floor and become utterly useless, it requiring considerable repair work in order to replace or repair the damaged posts. It is therefore desirable to have a guard post which may be positioned at the loading door opening and which will restrain the handling equipment from striking the door opening. The guard posts should be self supporting and capable of absorbing an impact with the handling equipment used in a warehose, and if struck with a sufficient severe impact be capable of being quickly and easily replaced. It is therefore an object of the present invention to provide a guard post that is positioned at the opening of a loading dock door in a building which will provide protection to the door opening and in particular to the guide rails of an overhead door that would be positioned in the opening.

SUMMARY OF THE INVENTION

The present invention provides an impact resistant guard post for the protection of the loading door apparatus in a warehouse. The post comprises an upright element preferably formed of an angle iron which has a base plate that is anchored to a floor and has a pair of brace members secured to the upright element to extend therefrom at an acute angle. Each brace member is inclined at approximately 30° to the floor surface and is anchored to the floor by a foot plate.

An object of the invention is to provide a guard post located at a door opening of a warehouse building which will protect the opening hardware from being damaged by load handling equipment.

DESCRIPTION OF THE PREFERRED EMBODIMENT

Figure 1:
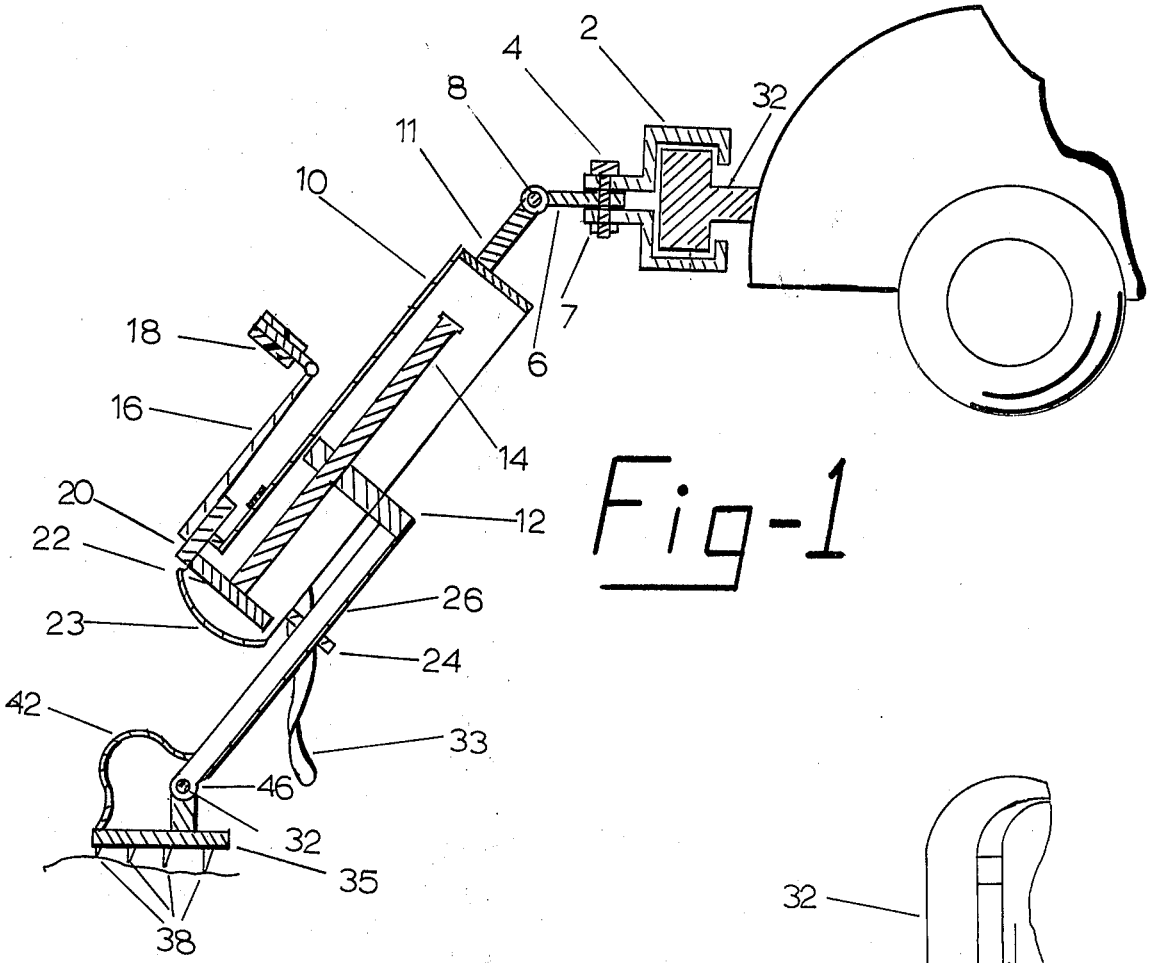
FIG. 1 is a perspective view showing guard posts of the instant invention installed in place in an opening in a building.
Figure 2:
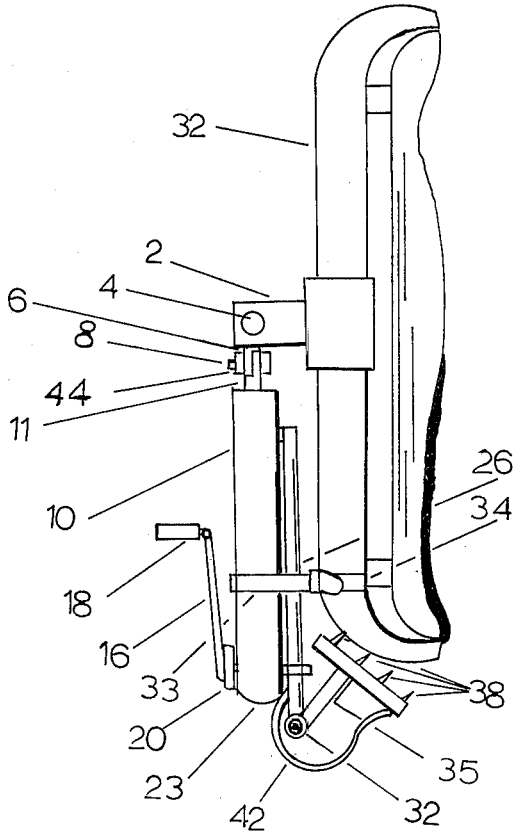
FIG. 2 is an enlarged side elevational view with parts broken away showing the orientation of the guard posts and the door opening.
Figure 3:
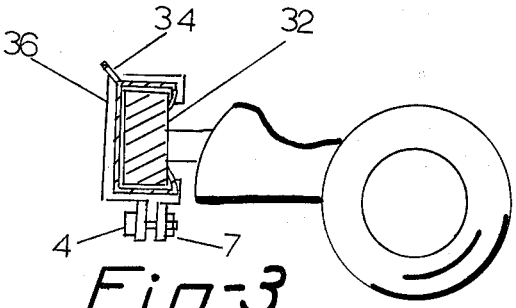
FIG. 3 is a vertical front elevational view of the guard post.
Figure 1:
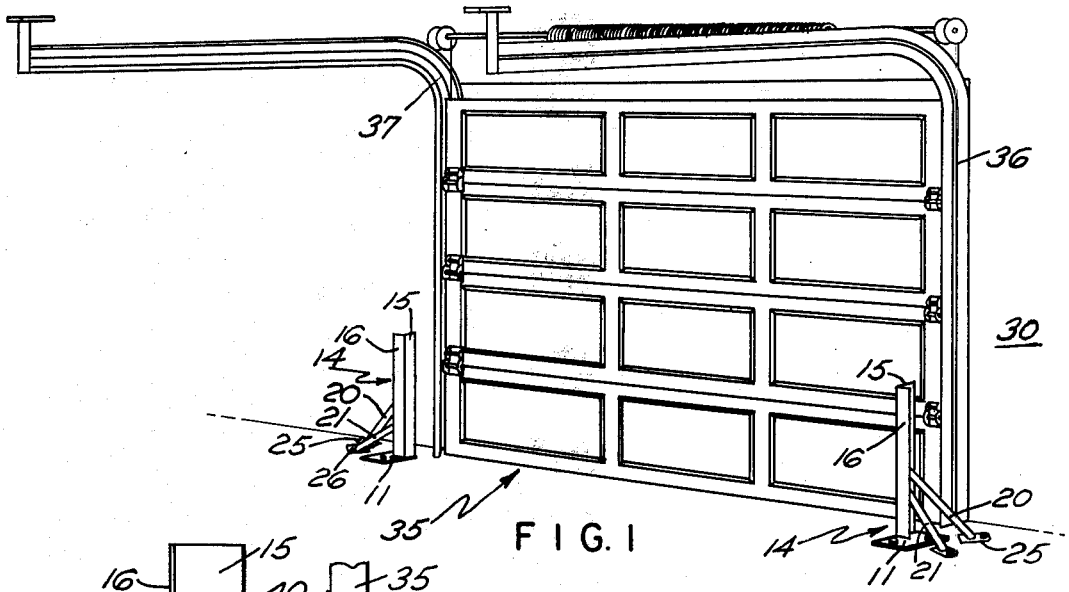
Figure 2:
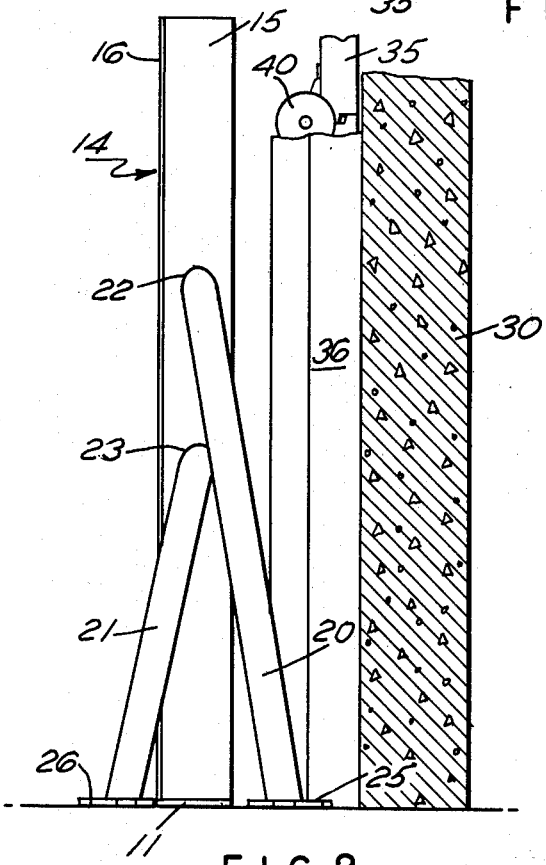

The present invention is concerned with a guard post which will protect an opening in a building, and more particularly the opening in a building of a warehouse type which has a loading dock to which trailer trucks and other vehicles would use and be loaded from the warehouse by handling equipment such as lift trucks and the like. The guard post is designed to be placed adjacent the edge of the opening on either side thereof and thus the guard post is deployed in pairs, there being a righthand guard post assembly and a lefthand guard post assembly.

Referring to the drawings, the guard post assembly comprises a base plate 11, which is provided with two apertures therethrough designated 12 and 13. Secured to the base plate and rising vertically therefrom is the guard post generally designated 14 commonly known as an angle iron which is composed of a pair of plates that are right angularly arranged to each other and which are designated 15 and 16. The guard post is securely fastened to the base plate 11 as by welding and preferably rises from the base plate a distance of approximately one meter in order to provide the necessary protection with the utilization of most load handling equipment, although it will be understood that it can vary in its vertical extent depending upon a particular application. Extending from the inner face of the element 15 are a pair of brace members 20 and 21 which extend away from the member 15 at an acute angle thereto and at an acute angle to each other. The brace members may be conveniently made from tubular stock, the brace member 20 being secured as by welding at 22 to an upper extent of the guard post 14, while the member 21 is secured as by welding at 23 to a lower extent of the guard post 14. The bottom or outermost ends of the brace members are provided with foot plates 25 and 26 and terminate at a level which is on the same planar extent of the base plate 11 at an angle to the foot plate on the order of 60°. The foot plates 25 and 26 whose position relative to members 20, 21 may vary, are respectively provided with apertures 27, 28.

The building in which the guard posts are utilized is provided with the usual outer wall 30 that may be of suitable masonry material or any other normal building material and is normally provided with a protective opening plate such as 32. The opening is conventionally secured by an overhead door 35 which, as is well known to those skilled in the art, is made up of a plurality of sections that are guided for upward movement by guide rails such as 36, 37 and extending from a hinge assembly, such as 38, is a shaft 39 that carries a roller 40 that engages in the rails such as 36 and 37.

Figure 4:
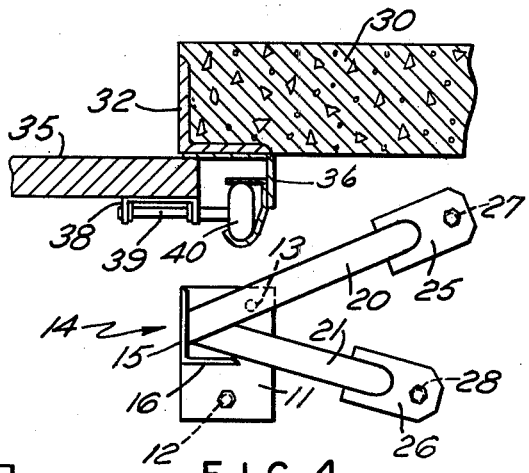
FIG. 4 is a top view partly in section showing the guard post and its relationship in plan to the door opening in the building.
Figure 3:
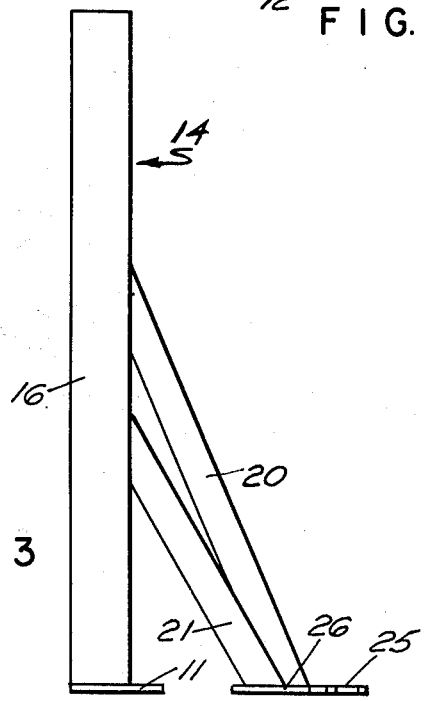

As will be apparent particularly by examining FIG. 4, it will be seen that the guard post of the instant invention has the face of member 15 substantially in line with the opening through the building wall. Further, the guard post is positioned so that the distance between it and the rails 36 and 37 is small, something on the order of 50 millimeters and will be secured in place by the use of lag bolts or other suitable fastening means that will grasp the floor which may be concrete or the like securely.

It would be apparent that if a fork lift or other load-handling equipment truck strikes the guard post that the brace members 20 and 21 will support the post from deflection and under normal operating conditions will prevent the post from being dislodged. Also because of the proximity to the opening, the load and/or the tines of the fork lift will be prevented from striking the guide rails such as 36 and 37. It will be further apparent that the positioning of the brace members 20 and 21 is such that a blow delivered to the guard post will substantially resist any movement or bending of the guard post.

The present invention, therefore, provides a guard post for placement at the opening of a loading lock door which will protect the door and particularly the guide rail for an overhead door from impact by virtue of handling equipment such as lift trucks and the like. Further, if the guard post is severely damaged by a blow, it may be easily replaced without the necessity of expensive construction and incident damage to a concrete floor or other support floor on the inside of the building adjacent the loading dock door.

I claim:

1. In a building having a loading dock opening with a door, a guard post for said opening comprising an upright element, a base plate adapted to be anchored to a supporting surface, two brace members secured to said upright element, said brace members extending away from said upright element at an acute angle to each other, said upright element secured to said base plate, said brace members being secured to said element at a vertical position substantially intermediate thereof and extending away from the element at an acute angle to the vertical extent thereof, means at the terminus of the brace members to anchor the same to a supporting surface, said upright element located substantially in line with said opening and closely adjacent thereto to block contact of a lift truck with the interior face of said opening.

2. In a building having a loading dock door as in claim 1 wherein said upright element is spaced from said opening by a small distance to prevent the tines of a lift truck from becoming wedged between the guard post and the opening.

* * * * *